US009415607B2

(12) United States Patent
Preckel et al.

(10) Patent No.: US 9,415,607 B2
(45) Date of Patent: Aug. 16, 2016

(54) DEVICE FOR APPLYING DECORATIONS TO CONTAINERS

(71) Applicant: KHS GmbH, Dortmund (DE)

(72) Inventors: Katrin Preckel, Gelsenkirchen (DE); Markus Reiniger, Monchengladbach (DE); Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 14/358,837

(22) PCT Filed: Oct. 18, 2012

(86) PCT No.: PCT/EP2012/004360

§ 371 (c)(1),
(2) Date: May 16, 2014

(87) PCT Pub. No.: WO2013/075774

PCT Pub. Date: May 30, 2013

(65) Prior Publication Data

US 2014/0313247 A1 Oct. 23, 2014

(30) Foreign Application Priority Data

Nov. 23, 2011 (DE) ..... 10 2011 119 169

(51) Int. Cl.

| | |
|---|---|
| ***B41F 15/30*** | (2006.01) |
| ***B41J 3/407*** | (2006.01) |
| ***B41J 11/00*** | (2006.01) |

(52) U.S. Cl.
CPC ..... *B41J 3/4073* (2013.01); *B41F 15/30* (2013.01); *B41J 11/0015* (2013.01)

(58) Field of Classification Search
CPC .... B41F 15/30; B41F 15/0895; B41F 17/006; B41F 17/18; B41F 17/26; B41F 19/001
See application file for complete search history.

(56) References Cited

U.S. PATENT DOCUMENTS

| | | | | |
|---|---|---|---|---|
| 3,368,482 | A | 2/1968 | Lusher et al. | |
| 3,683,799 | A * | 8/1972 | Szpitalak | 101/40 |
| 4,491,613 | A | 1/1985 | Hahn | |
| 5,193,456 | A * | 3/1993 | Wolfe et al. | 101/40 |
| 5,967,034 | A * | 10/1999 | Baiada | 101/216 |

(Continued)

FOREIGN PATENT DOCUMENTS

| | | |
|---|---|---|
| DE | 2552171 | 6/1977 |
| DE | 2748600 | 5/1978 |

(Continued)

*Primary Examiner* — David Banh
(74) *Attorney, Agent, or Firm* — Occhiuti & Rohlicek LLP

(57) ABSTRACT

An apparatus for use in connection with application of decoration to a container by printing thereon includes a container transport system comprising a processing position configured to receive a container, a coating installation disposed at the processing position, and a transfer element. The transfer element applies a base coat to the container by rolling on or off the container.

18 Claims, 7 Drawing Sheets

(56) References Cited

U.S. PATENT DOCUMENTS

| | | | | |
|---|---|---|---|---|
| 2004/0173110 | A1* | 9/2004 | Roesch et al. | 101/136 |
| 2004/0221546 | A1* | 11/2004 | Zwilling | 53/67 |
| 2007/0193223 | A1* | 8/2007 | Schach et al. | 53/167 |
| 2007/0204563 | A1* | 9/2007 | Kramer et al. | 53/167 |
| 2009/0126591 | A1* | 5/2009 | Puig Vila et al. | 101/486 |
| 2009/0213201 | A1* | 8/2009 | Numata et al. | 347/103 |
| 2010/0229737 | A1* | 9/2010 | Ouchi | 101/4 |
| 2010/0257819 | A1* | 10/2010 | Schach | 53/411 |
| 2011/0179959 | A1 | 7/2011 | Gerigk et al. | |
| 2013/0176358 | A1* | 7/2013 | Yamada et al. | 347/20 |
| 2015/0059601 | A1* | 3/2015 | Domeier et al. | 101/40 |

FOREIGN PATENT DOCUMENTS

| | | |
|---|---|---|
| DE | 69603444 | 3/2000 |
| DE | 102008049241 | 4/2010 |
| DE | 102009020702 | 12/2010 |
| EP | 0341400 | 11/1989 |
| WO | WO2009/018892 | 2/2009 |
| WO | WO2009/052890 | 4/2009 |
| WO | WO2009/060930 | 5/2009 |
| WO | WO2010/048119 | 4/2010 |

* cited by examiner

DEVICE FOR APPLYING DECORATIONS TO CONTAINERS

RELATED APPLICATIONS

This application is the national stage entry under 35 USC 371 of PCT application PCT/EP2012/004360, filed on Oct. 18, 2012, which claims the benefit of the Nov. 23, 2011 priority date of German application DE 10 2011 119 169.4, the contents of which are herein incorporated by reference.

FIELD OF INVENTION

The invention relates to application of decorations onto a container, and in particular, to an apparatus for digitally printing decorations onto a container.

BACKGROUND

Methods and devices for generating decorations or decorative features by printing on an outer surface of a container are known. It is also known to apply multicolored prints to a container by contact-free printing, for example, by inkjet printing, with each print head having a plurality of jets for the application of the different colors of ink. The jets are controlled electrically and individually.

Although the direct printing of containers offers considerable advantages, inter alia in terms of flexibility of the printed image and its design and/or alteration and also with regard to costs, the problem persists that when recycling containers of this kind, container material and printing ink both make their way into the recycling material. This leads to an unwanted contamination of the recycled material.

To resolve this problem, WO 2010/048119 suggests that an additional intermediate or base coat be applied on the outer surface of the particular container. Then, in one or more further processing steps, a multi-colored print is applied to the base coat. A known method for applying the material forming the base coat is spraying. However, spraying is time-consuming for large-area printing. In addition, some of the sprayed or squirted base coat material inevitably escapes into the environment.

The particular decoration thus comprises, in the end, the base coat and the print. With the base coat, not only is an improvement of the adhesion of the print achieved, but there is then also the possibility of selecting the material for the base coat and the printing colors or printing inks taking account of the material of the container so that the adhesion between the print and the base coat is greater than the corresponding adhesion between the base coat and the container.

The adhesion between the base coat and the container is selected so that during the entire container cycle and also in the event of any re-use of the containers, the base coat, with the print imprinted thereon, does not detach from the particular container. But in the event of recycling, the base coat together with the print that still adheres to it, can be detached from the containers or from their walls. The process of detaching the base coat from the container can be carried out, for example mechanically and/or with a suitable liquid medium etc. Examples of materials suitable as a base coat material include polyolefins or other monomers, and plastics or polymers that can be cross-linked by processing with UV radiation.

A difficulty that arises with known solutions is that the fluids used for base coats, coatings, finishing etc. tend to have low viscosity. As a result, it has not been possible to handle them at high machine speeds because of the risk of misting and detachment.

SUMMARY

An object of the invention is to provide a simple way to apply base coat material that forms a base coat on a container so that a particular decoration can be printed onto containers in an environmentally friendly way, over a large area of the container, and with high container throughput.

The particular advantage of the invention relies on the use of a transfer element or pad, in particular of a transfer element or pad with an inflow from the rear, for application of the base coat material. This completely resolves the aforesaid contamination problems.

Moreover, the use of a transfer element is clearly more economical than, for example, the use of additional print heads.

Furthermore, the fluid to be applied is transferred from the coating installation by rotating transfer elements carrying the transfer coat. In doing so, the particular container, e.g. the bottle, is rolled, preferably slip-free, for the application of the base coat or of the base coat material forming this base coat. This rolling takes place, as a rule, by the transfer element and the particular container rolling against each other. Ideally, there is no direct touching contact of the elements of the container and the transfer coat. Instead, the fluid adhering in the area of the greatest proximity of the container and transfer coat or transfer surface forms a fluidic bridge.

The transfer coat is bent in a convex manner, preferably in a circular cylindrical convex manner, around an axis, for example around an axis of rotation or pivot axis of the transfer element. Moreover, the transfer element is a roller-like or ring-like element forming the transfer coat on its preferably circular-cylindrical outer surface.

As used herein, the term "containers" means cans, bottles, tubes, pouches, in each case made of metal, glass and/or plastic, and also other packaging means that are suitable for filling with liquid or viscous products.

As used herein, the term "containers" refers to containers made of plastic, for example PET (polyethylene terephthalate).

As used herein, the terms "substantially" and "approximately" mean deviations from exact values in each case by +/−10%, and preferably by +/−5% and/or deviations in the form of changes not significant for functioning.

In one aspect, the invention features an apparatus for use in connection with application of decoration to a container by printing thereon. Such an apparatus includes a container transport system having a first processing position configured to receive a first container, a first coating installation that is part of the first transfer element and that is disposed at the first processing position, and a first transfer element. The first transfer element is configured to apply a base coat to the first container by either rolling on the container or rolling off the first container.

In some embodiments, the first transfer element is a rotating transfer element that includes a transfer coat. In these embodiments, the first container rolls in a slip-free or substantially slip-free manner on an outer surface of the first transfer element to receive the base coat. Among these embodiments are those in which the first transfer element is configured such that, in operation, the first transfer element avoids contact with the first container. Also among these embodiments are those in which, in an area of greatest proximity between the first container and the first transfer element, an adjustable perpendicular surface distance separates the first container and the first transfer element.

In some embodiments, the first transfer element includes a transfer coat that is permeable by a coating material that can flow. Among these embodiments are those in which the transfer coat includes a sponge-like buffer coat, an elastic coat, a soft coat, or an absorbent coat. In some cases, there is also a porous wall. In these cases, the first transfer element includes the porous wall in the transfer coat. The porous wall includes a carrier-and-distribution coat and a plurality of openings. The openings, which can be micro-openings or micro-pores, enable the base coat material to be transported under pressure and to be evenly distributed onto the transfer coat. The base coat material is transported in an axial direction that is radial to either a circulation of the first transfer element, an axis of rotation of the first transfer element, or an axis of rotation of a carrier of the first transfer element.

In additional embodiments, the first transfer element includes a rotating transfer element. In these embodiments, the first coating installation includes a station, and the rotating transfer element is moved past the station to apply base coat material onto the transfer coat before the rotating transfer element, in its further circulation, reaches a transfer position at which the first container is rolled on the transfer coat.

Other embodiments include a sensor disposed at the transfer position. This sensor is configured to measure a distance between the first container and a structure selected from the group consisting of the first transfer element and the transfer coat.

Yet other embodiments include a supply-or-buffer chamber in which the porous wall separates an inside of the supply-or-buffer chamber from either the transfer coat or a damping-and-buffer coat, and in which the inside of the supply-or-buffer chamber is connected by a pipe to a source that supplies the base coat material under pressure to the supply-or-buffer chamber. In such embodiments, the supply-or-buffer chamber is connected to a further pipe that is disposed to return base coat material from the supply-or-buffer chamber to the source.

Also within the scope of the invention are embodiments that have a carrier that can be driven for rotation around a carrier axis. In these embodiments, the first transfer element is disposed on the carrier. In such cases, the apparatus also has a second transfer element that has the same structure as the first transfer element, and that is also disposed on a carrier.

Additional embodiments include those having a draining installation to collect excess base coat material from either a transfer area between the first container and the first transfer element, a damping-and-buffer coat that forms a transfer coat, or a porous wall that acts as a carrier-and-distribution coat.

Other embodiments have a heating installation for tempering the base coat material. The heating installation is arranged in the supply-or-buffer chamber.

Other embodiments have a sensor disposed at the transfer position. The sensor is configured to monitor application of the base coat on the first container.

Some embodiments also have a first rotor that can be driven to rotate about a vertical machine axis. The first processing position is disposed on this first rotor. The apparatus also has a second processing position disposed on the first rotor the second processing position being configured to receive a second container. The second processing position includes a second coating installation that includes a second transfer element. The second transfer element is configured to apply a base coat to the second container by either rolling on the second container or rolling off the second container. Some of these embodiments have a second rotor disposed to receive containers from the first rotor. The second rotor includes processing positions for printing onto the base coat provided at the first rotor. In these embodiments, the first and second rotors define at least part of a transport stretch.

Some embodiments also have a closing element provided on the first transfer element. The closing element is a one-part closing element or a multi-part closing element that is either pivotable or movable. The closing element can be a closure cap or a cover.

Among the foregoing embodiments are those in which the first transfer element includes a transfer coat, and in which the closure element, when brought to a position at which the closure element is to be used, cooperates with the transfer coat to form an outlet space or a gap. The fluid is either a cleaning agent, a solvent, or a mixture thereof that flows in a circuit that passes through the outlet space or gap.

Some embodiments also include an inkjet print head disposed to direct ink toward the base coat on the first container.

BRIEF DESCRIPTION OF THE DRAWINGS

The invention is explained in more detail below by means of the figures using examples of embodiments in which.

DETAILED DESCRIPTION

Figure 1:
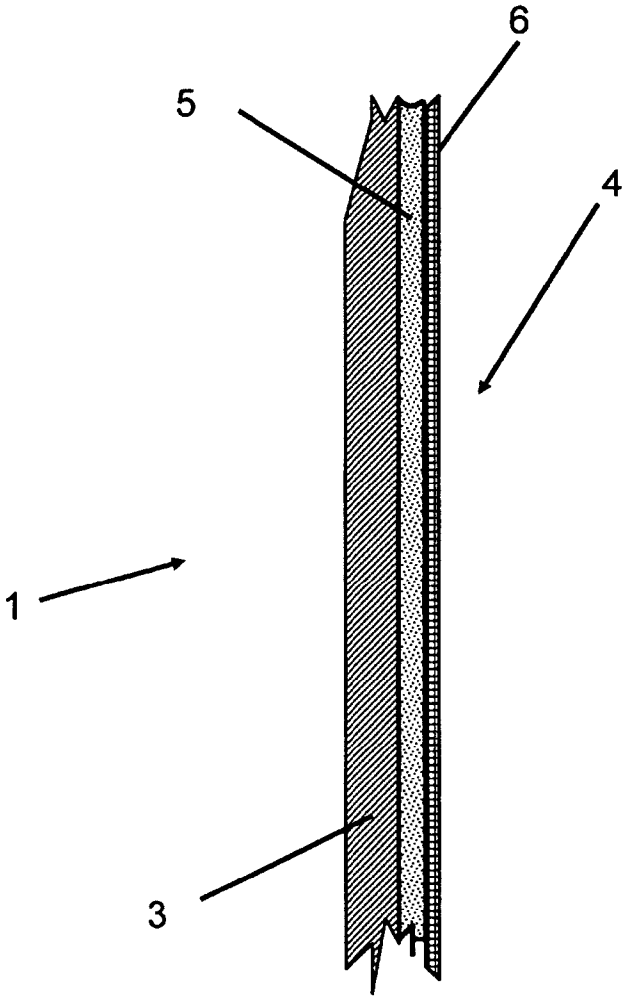
FIG. 1 is a schematic representation and in cross-section of a container wall of a container and a decoration applied onto the outer surface of the container wall, consisting of a separating or base coat and a print.

In the figures, an installation 2 receives a container 1 and prints a decoration 4 the outside of the container's wall 3. These containers 1 are generally bottles, preferably plastic bottles, such as PET bottles. As shown in FIG. 1, the container decoration 4 consists of a base coat 5, or "print carrier coat." The base coat 5 is applied directly onto the container wall 3. A multicolor print 6 is then applied onto the base coat 5.

Among the functions of the base coat 5 is to improve the adhesion of the print 6 on the container wall 3, and to assure a consistent printing surface, thereby avoiding the need to consider the container or bottle material when formulating an ink.

Also among the functions of the base coat 5 is to take on the recycling characteristics of the ink. For example, when recycling a particular container 1, it becomes possible to easily detach the decoration, i.e. the base coat 5 together with the print 6, from the container 1. This detachment can be carried out by a drive-sink process in which the components of the shredded or chopped container 1 are introduced into a separating liquid that separates the components of the container decoration 4 from the material of the container wall 3 and at the same time, separates the shredded components by floating them either in the separating liquid or in a further liquid.

The selection of a material for the base coat 5 and the print 6 or for the printing colors or printing inks used for this print 6 takes into account the material from which the containers 1 are made. Among other advantages, this enables the adhesion between the print 6 and the base coat 5 to be greater than the adhesion between the base coat 5 and the container wall 3. It also enables the total thickness of the decoration 4 to be less than the thickness of the material of the container wall 3.

Additionally, the materials are selected such that the adhesion of the print 6 on the base coat 5 and the adhesion of the base coat 5 on the container wall 3 are sufficiently great so that, during the entire container cycle, and in particular also in the event of any re-use of the containers 1, no separation occurs. Furthermore, the material for the base coat 5 is also selected so that the base coat 5 is flexible enough to follow deformations of the particular container 1.

Polyolefins or other monomers are suitable as a material for the base coat 5. The print 6 is preferably made by contact-free printing. Such contact-free printing can be carried out with print heads, each of which generates one color set of the multicolored print 6. The print heads are inkjet print heads that have electrically controlled jets to apply the printing color or printing ink.

Figure 2:
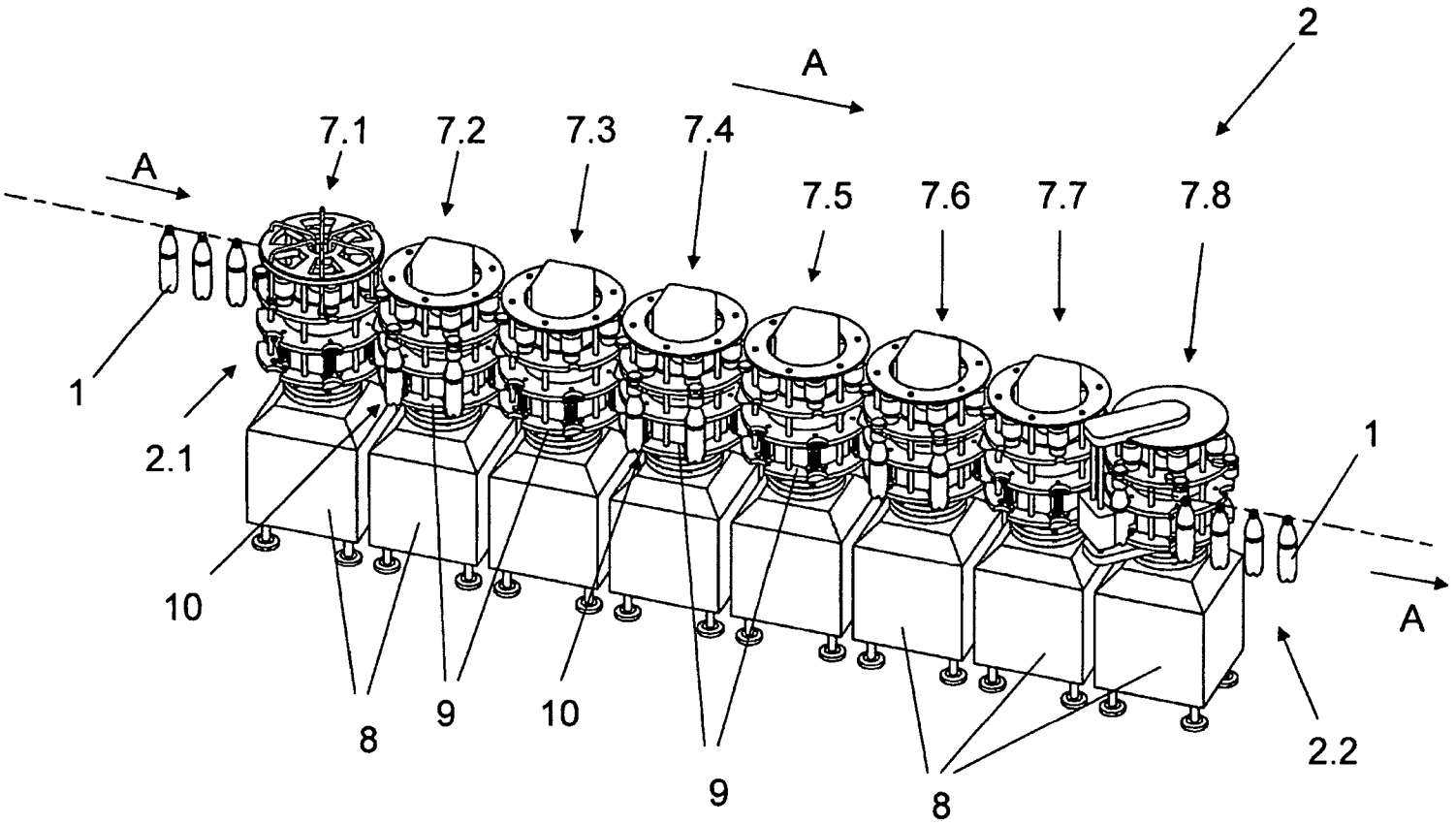
FIG. 2 is a simplified schematic and perspective representation of a device or installation for the application of the decoration in the form of a multiple or multi-colored print onto the containers.
Figure 3:
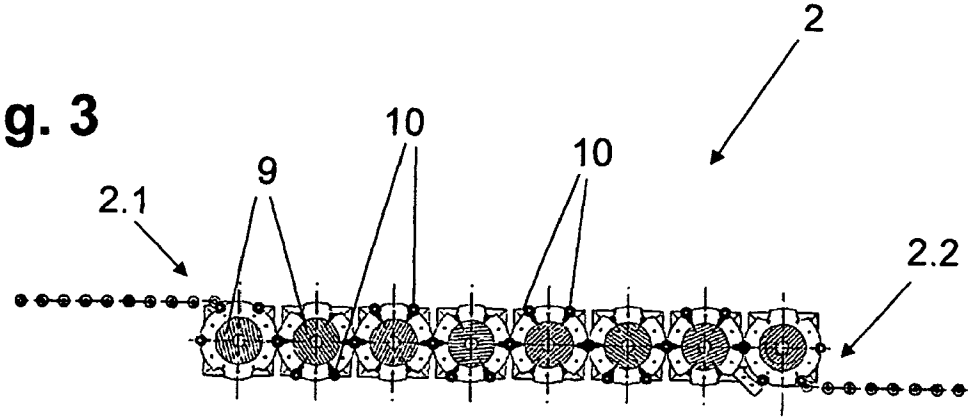
FIG. 3 is a schematic representation of the device or installation of FIG. 2 in plan view.

Referring to FIG. 2, an installation 2 comprises modules 7.1-7.8 adjacent to each other in a container transport direction A. Each module has an base unit 8. The base units 8 of the different modules 7.1-7.8 are identical.

Each base unit 8 has a rotor 9 that is driven to rotate around a vertical module or machine axis MA. The rotor 9 is fitted on its circumference with a plurality of container holding positions or processing positions 10. The processing positions 10 are designed according to the function of the particular module 7.1-7.8 that they inhabit.

During the operation of the installation 2, the rotors 9 are driven synchronously, but in opposite directions. As a result, whenever a processing position 10 of a rotor 9 has reached a connection or transfer area of an adjacent rotor 9, a processing position 10 on the rotor 9 is ready to receive a container 1 from or transfer a container 1 to its adjacent rotor 9.

Figure 4:
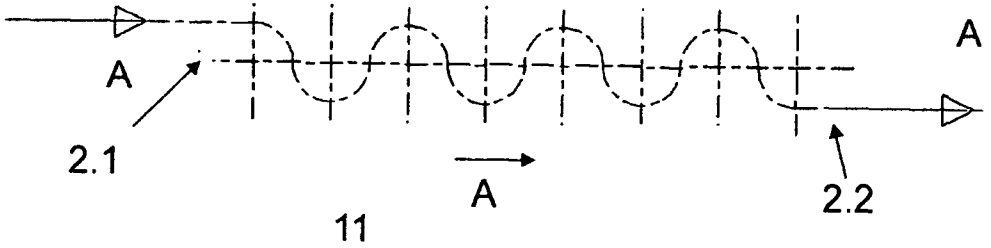
FIG. 4 is a schematic representation and in a plan view of a transport or conveyance path of the containers through the device or installation in FIG. 2.

The rotors 9 are connected to each other for transport purposes. Collectively, the rotors 9 form a meandering container transport stretch 11, as shown in FIG. 4. The containers 1 are moved along the transport stretch 11 in the container transport direction A from a container infeed 2.1 to a container release 2.2.

In the illustrated embodiment, a first module 7.1 forms an inlet module by means of which the containers 1 are supplied to the container transport stretch 11. There is however the possibility that, even in this first module 7.1, a pre-processing of the containers 1 to promote printing takes place.

In a base-coating module 7.2, transfer elements 14 apply a base coat 5 onto the outer surface of the container wall 3. The transfer elements 14 rotate together with the containers 1.

The third through seventh modules 7.3-7.7 following in container transport direction A are print modules. In each print module 7.3-7.7, or at the processing positions 10 of their rotors 9, one color set of the multi-colored print 6 is applied onto the containers 1 or onto the base coat 5. Some of the print modules 7.3-7.7 or the processing positions 10 on the rotors 9 also include facilities for drying or cross linking the printing color or printing ink that forms the particular print 6.

The eighth module 7.8 forms an outlet module that moves the printed containers onto the container outlet 2.1 and onto the adjacent transport stretch.

In some embodiments, the transport installations for supplying and removing the containers in and out of the installation 2 and also the rotors 9 and their processing positions 10 are made such that the containers 1 are suspended from an area near their upper container openings. Alternatively, a centering bell can hold containers 1 standing on a bearing plate.

The printing of the containers 1 in the printer modules 7.3-7.7 takes place in a contact-free free manner using inkjet print heads. At least one print head is provided at each processing position 10.

The particularity of the invention lies in the design of the base-coating module 7.2 or of the processing positions 10 at which the application of the base coat 5 takes place by rolling.

The seventh module 7.7 can be a finish-coat module that is designed in a manner similar to the base-coating module 7.2. At the finish-coat module, a similar method is used for subsequent sealing, lacquering, or otherwise coating of the printed image. Such a finish-coat module is not described or named separately as it is basically built and operated in a manner similar to the base-coating module 7.2. In effect, in such a module, the "base coat" just becomes the union of the base coat 5 and the print 6.

FIG. 4 shows, in a schematic detail and in plan view, an application or coating installation 12 of a processing position 10 of the base-coating module 7.2, together with a partial illustration of a container 1 during the application of the liquid or pourable base coat material forming the base coat 5. Each processing position 10 of the coating module 7.2 is designed with an independent coating installation 12.

The coating installation 12 includes a rotating carrier 13 that can be driven around a carrier axis TA of the coating module 7.2 (arrow B) synchronously with the rotation of the rotor 9. The carrier axis TA is oriented parallel to the machine axis MA.

Distributed around the carrier axis TA at regular angular distances and at the same radial distance from the carrier axis TA are segment-like transfer elements 14. Each transfer element 14 is mounted on the rotating carrier 13 such that it can pivot around its pivot axis PA, which is parallel to both the machine axis MA and to the carrier axis TA.

Each transfer element 14 has a side that is a radially outer side relative to the carrier axis TA. Each transfer element 14 has a transfer coat 15 on this radially outer side. The transfer coat 15 is part of a circular cylinder surface around an axis running parallel to the machine axis MA, the carrier axis TA and the pivot axis PA.

With rotating carriers 13 driven in rotation in the direction of arrow B, each transfer element 14 is first moved past a station 16 at which the base coat material that forms the base coat 5 is applied onto the transfer coat 15 at a defined coat thickness, a defined width, with the width direction being the direction along the pivot axis PA, and with a defined length, with the length direction being along the direction of rotation B. To apply this base coat material, the station 16 has a drum 17 driven to rotate around an axis parallel to the machine axis MA. At a station 16, which is not illustrated, the drum 17 is given an even application of the base coat material of the necessary coat thickness.

The transfer elements 14 roll with their transfer coat 15 in a slip-free or in a substantially slip-free manner on the drum 17. The rolling is carried out by controlling pivotal movement around the pivot axes PA.

The rotating carrier 13 then takes the transfer elements 14, which have been provided with the base coat material on their respective transfer coats 15, to a transfer position 18. At the transfer position 18, the base coat material is transferred from the transfer coat 15 onto the outer surface of the container wall 3 of a container 1 that is standing ready to receive it. This is achieved by rolling the transfer coat 15 onto the container.

To achieve this with the rotating carrier 13 rotating continuously in the direction of the arrow B, the container 1 is rotated about its vertical container axis in the direction of the arrow C. Meanwhile, the relevant transfer element 14 is pivoted or rotated in a controlled manner around its pivot axis PA in such a way that the container 1, and in particular, the outer surface of its container wall 3, rolls in a slip-free or substantially slip-free manner on the transfer coat 15. As a result, the base coat material is applied onto the container wall 3 at the thickness needed for the base coat 5.

The coating installation 12 also has a finishing station 19 for drying, hardening, or cross-linking the base coat 5. The finishing station 19 carries this out by, for example heating the base coat 5 or illuminating the base coat 5 with UV light. Heating the base coat 5 can be carried out by illuminating the base coat 5 with infrared heat radiation.

If a liquid material is used as the base coat material, the transfer elements 14 are designed in each case with a soft and absorbent material, for example with a sponge-like material, on their transfer coats 15. In such cases, the application of the base coat material takes place by lightly brushing over the outer surface of the container wall 3 with the transfer coat 15. This is carried out by rolling the transfer coat 15 without exerting any significant force on the container 1.

In a preferred embodiment of the coating installation 12, the transfer coats 15 are segments of a circular cylinder that concentrically encloses the carrier axis TA. As a result, controlled pivoting movement of the transfer elements 14 around the pivot axes PA is not necessary.

Figure 6:
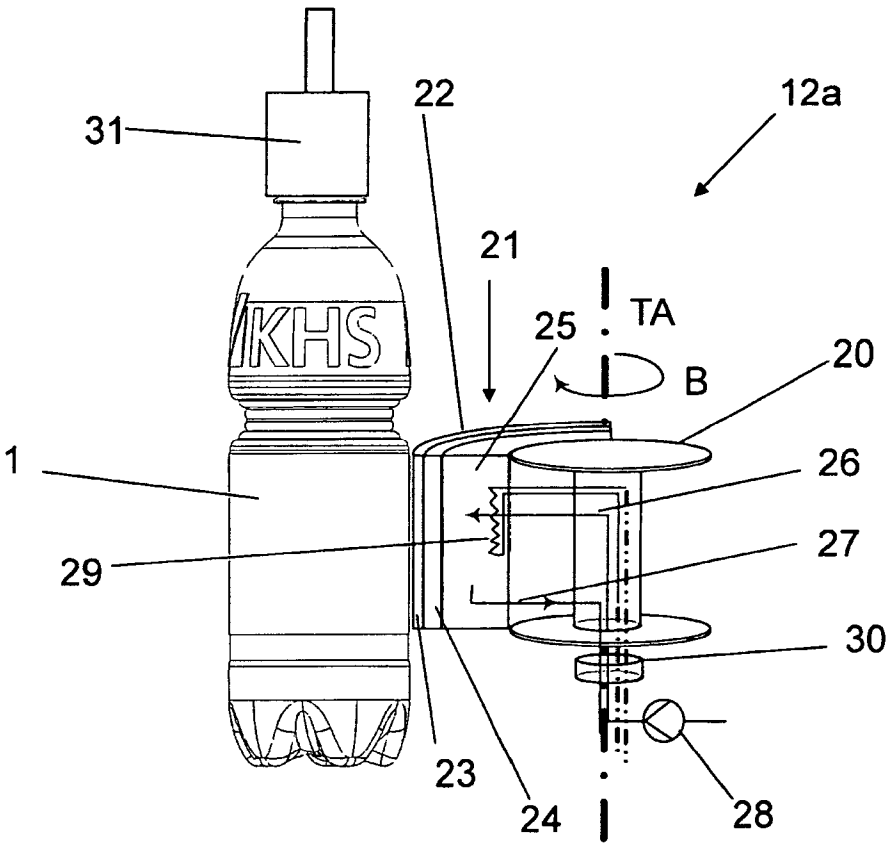
FIGS. 6, 7 and 8 are simplified perspective representations of a coating installation of a processing station for the application of the base coat onto the containers in the case of different embodiments of the invention.

FIG. 6 shows a first alternative coating installation 12*a* that is provided at each processing position 10 of the coating module 7.2 instead of the coating installation 12.

The first alternative coating installation 12*a* comprises a carrier 20 driven around the carrier axis TA synchronously with the rotary movement of the rotor 9 in the direction of the arrow B. On the carrier 20 are segment-like application and transfer elements 21 disposed around the axis TA and offset at regular angular distances. The transfer elements 21 form a transfer coat 22, in each case in a radially outer position in relation to the axis TA, for transferring the base coat material onto a container 1 as it rolls on this transfer coat 21.

The transfer elements 21 are arranged in a radially outer position on a damping-and-buffer coat 23 made of a soft, elastic, absorbent, and permeable material. The buffer coat 23 is provided on a transfer coat carrier 24 that forms, at least on its radially outer side in relation to the axis TA, a partial circular cylinder surface bent around the axis TA so that the transfer coat 22 is also correspondingly bent.

The transfer coat carrier 24 is made of a material with sufficient solidity, for example of metal (sintered metal) or ceramic (sintered ceramic). The material is porous or made with a plurality of openings or micro-openings such that, inside the transfer coat carrier 24, an even pressure distribution arises for the base coat material fed under pressure through the transfer coat carrier 24, and, in particular, there is also an even distribution of the base coat material in the damping-and-buffer coat 23. This results in the coat being saturated as evenly as possible with the liquid base coat material.

On the side of the transfer coat carrier 24 turned away from the damping-and-buffer coat 23, or the wall of ring-segment shape forming this carrier, the transfer element 21 is provided with a supply-or-buffer chamber 25. The supply-or-buffer chamber 25 receives a buffer volume of the liquid base coat material. The interior of the supply-or-buffer chamber 25, which lies in a radially outer position in relation to the axis TA, is bounded by the transfer coat carrier 24 so that the base coat material can be transported from the supply-or-buffer chamber 25 under pressure through the transfer coat carrier 24 into the damping-and-buffer coat 23. Furthermore, the interior of the supply-or-buffer chamber 25 is connected by a pipe 26 to a source for the supply of the base coat material under pressure and to a pipe 27 to return excess base coat material to this source, of which only a pressure or feed pump 28 is shown in FIG. 6.

An electric heating system 29 is also provided within the supply-or-buffer chamber 25. The electric heating system 29 holds the base coat material at an optimum temperature for the coating so that conditions or parameters remain unchanged. The heating system 29 can also be used, if appropriately designed, to pyrolytically clean the transfer element 21 at the end of a production phase. The electrical connections of the heating system 29, and likewise the pipes 26 and 27, are routed via a rotary distributor 30 so that the source for the base coat material and installations for controlling and/or adjusting the heating system 29 for all the processing positions 10 of the coating module 7.2 can be housed jointly in the associated base unit 8.

The application of the base coat takes place on the first alternative coating installation 12*a* by rolling the container 1. This is achieved by suspending the container 1 on a container carrier 31 and using the container carrier 31 to rotate the container 1 around the vertical container axis in a slip-free or substantially slip-free manner on the particular transfer coat 22 in the direction of the arrow B. This is one by lightly brushing-over the outer surface of the container wall 3 with the transfer coat 22 without or substantially without the exertion of force by the transfer coat 22 on the container 1. The first alternative coating installation 12*a* also has a station, not illustrated, for drying or hardening the applied base coat 5.

Figure 5:
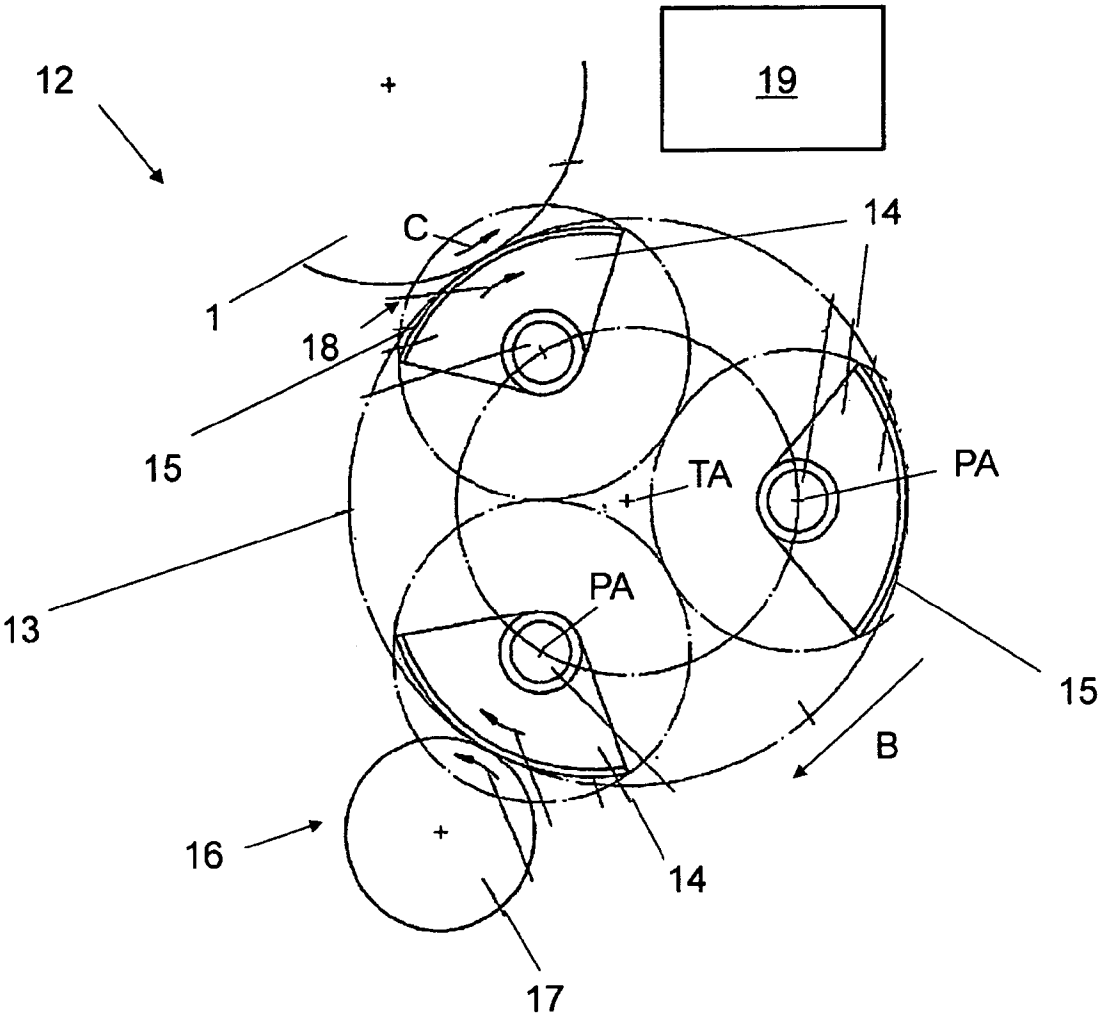
FIG. 5 is a simplified schematic representation of a coating installation of a processing station for the application of the base coat onto the containers.
Figure 7:
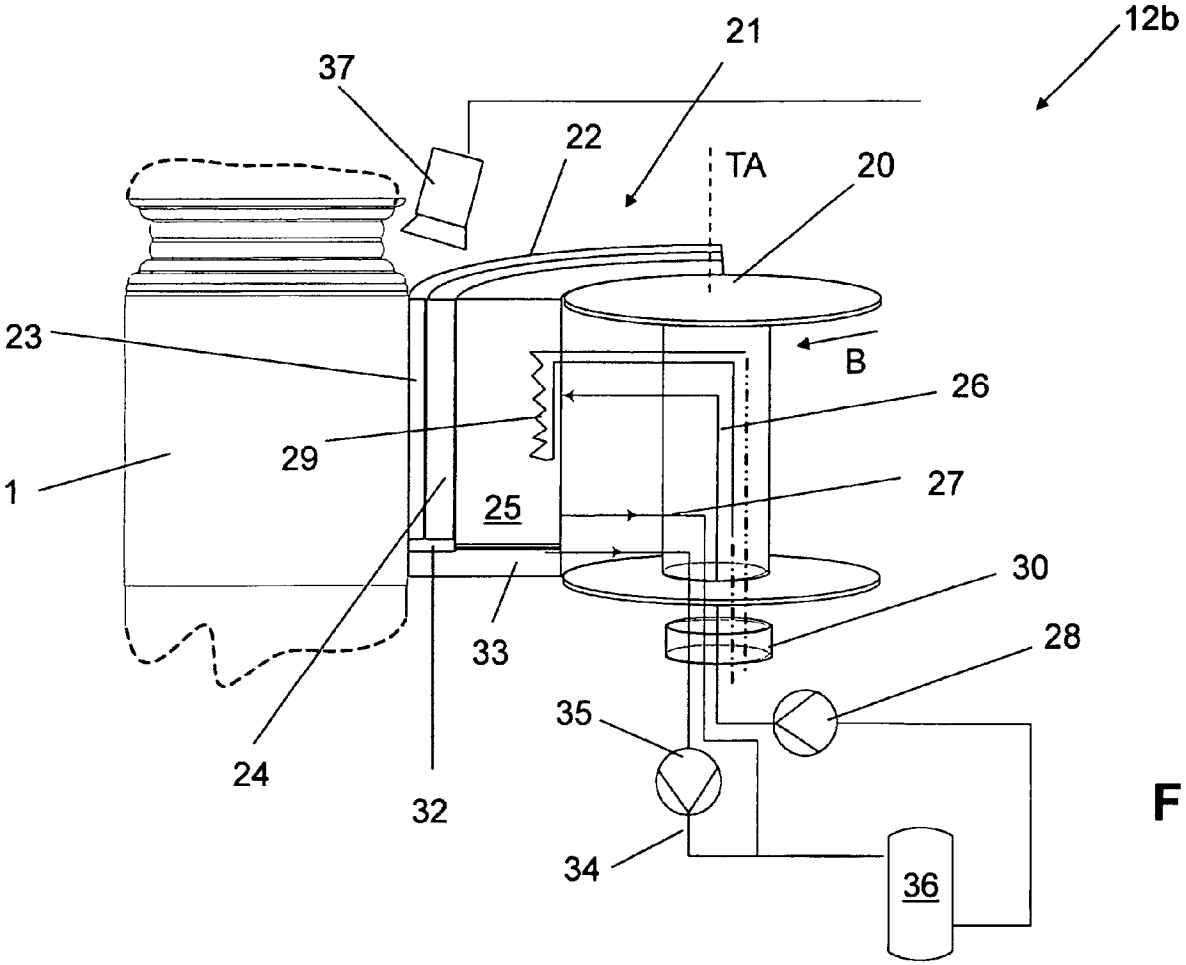

FIG. 7 shows a second alternative coating installation 12*b* that is provided for the application of the base coat 5 in each case at the processing positions 10 of the module 7.1. Many of the elements in second alternative coating installation 12*b* match those in first alternative coating installation 12*a*. These elements will not be described in detail in connection with FIGS. 7 and 8. For these elements, the same reference numbers are used as in FIG. 5.

The second alternative coating installation 12*b* differs from the first alternative coating installation 12*a* however because on the transfer element 21, the lower edge of the damping-and-buffer coat 23 and the ring segment-shaped wall forming the transfer coat carrier 24 lie against a ring segment 32 that is made of a porous material, for example metal or ceramic, with a plurality of micro-pores or micro-openings.

The ring segment 32 forms the inlet of a collection chamber 33 and, with the latter, a drainage unit for collecting and returning base coat material from the damping-and-buffer coat 23 and from the transfer coat carrier 24 during the operation of the installation 2, and also upon switching off the installation.

The collection chamber 33 is connected via a pipe 34 and a feed pump 35 to a chamber 36 to which the pump 28 is also connected and that is the source for the base coat material. This source is housed in the base unit 8 or an interim store for this material that is provided on the rotor 5. The pipe 34 is likewise routed by one or more rotary distributors.

The second alternative coating installation 12*b* is furthermore designed with a sensor 37, for example a laser sensor, for distance or occupation measurement. The sensor 37 supplies a signal that depends on the distance between the container outer surface and the transfer coat 22 and/or that depends on the elastic deformation of the damping-and-buffer coat 23 by the container 1. Such a signal provides a basis for controlling the delivery of the coating installation 12*a* to a particular container 1 to achieve the force-free or substantially force-free application of the coating material and/or a basis for monitoring the correct application of the base coat 5.

Figure 8:
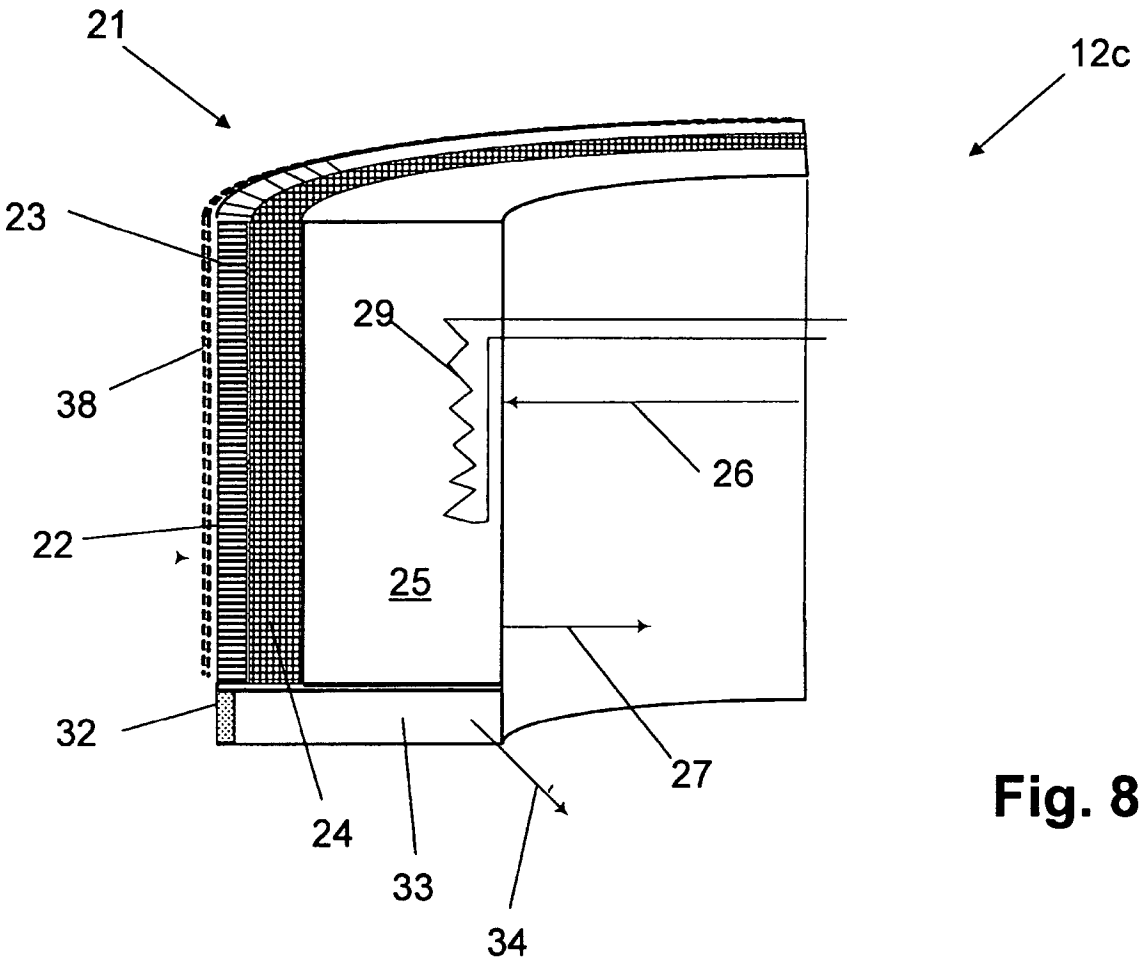

FIG. 8 shows, in a partial representation, the transfer element 21 of a third alternative coating installation 12*c* that differs from the second alternative coating installation 12*b* substantially only in that the ring segment 32 that forms the inlet into the collection chamber 33 is provided underneath the damping-and-buffer coat 23. Thus, with this embodiment, only excess or unnecessary base coat material is removed from the damping-and-buffer coat 23 by the ring segment 32 and the collection chamber 33, i.e. the ring segment 32 and the collection chamber 33 form a drainage system for the damping-and-buffer coat 23. In FIG. 7, the base coat material provided by the transfer coat 22 is indicated schematically by 38.

In a further development, a closure cap or cover is provided on or for the transfer element 21 for cleaning cycles, by means of which a closed drain space or gap can be created before the transfer coat 21. A cleaning agent or solvent can be flushed through the coats 24 and 23 after the application or sealing of the transfer coat 21. The cleaning agent or solvent is passed through a pipe 27 and is circulated or drained through the thus formed drainage space or gap and subsequently the collection chamber 33 by the pumps 28 and 35. This closure cap or cover is ideally designed as an automatically dispensing or moveable element.

The use of the vacuum pump 35 is not necessary. But its use reduces the loss of solvent or cleaning agent as pressure below atmospheric can be set intentionally in the outlet pipe thereby further reducing the structural cost for the sealing of the closure cap or cover.

The invention has been described above using examples of embodiments. It is clear that numerous variations and modifications are possible without thereby departing from the inventive idea underlying the invention. Thus, above it is assumed that the transfer coats 15 and 24 are designed in each case on transfer elements 14 or 21 in the form of segments. It is of course also possible for the particular coating installation 12, 12*a*, 12*b* and 12*c* to have a continuous annular transfer coat, enclosing, for example, the carrier axis TA of the particular carrier 13 or 20, this being in particular where the application of the base coat material takes place in such a way that the base coat completely encloses the particular container on a container outer area.

It is also possible to design the base layer 5 in a multi-coat manner with a plurality of individual coats, whereby then each individual coat is generated on different modules with device 2. As stated above, a sealing or coating can be applied in a similar way so that the term the "base coat" is here not to be understood in a limiting manner, but must be understood generally as "coating."

REFERENCE SYMBOL LIST

1 Container
2 Device or installation
2,1 Container inlet
2.2 Container outlet
3 Container wall
4 Container decoration
5 Base coat, coating
6 Print
7.1-7.8 Module
8 Base unit
9 Rotor
10 Processing position
11 Container transport stretch through the installation 2
12,12*a*,12*b*,12*c* Coating installation for applying the base coat material
13 Carrier
14 Transfer element
15 Transfer coat
16 Station
17 Drum
18 Transfer position
19 Station for hardening and/or crosslinking the base coat
20 Carrier
21 Transfer element
22 Transfer coat
23 Buffer coat
24 Transfer coat carrier
25 supply-or-buffer chamber
26,27 Pipe
28 Pump
29 Electric heating
30 Rotary distributor
31 Container carrier
32 Ring segment
33 Collection chamber
34 Pipe
35 Pump
36 Chamber
37 Sensor
38 Base coat material
A Container transport direction
B Direction of rotation of the carrier 13 or 20
C Direction of rotation of the container
A Axis of rotation of the carrier 13 or 20
TA Axis of rotation of the carrier 13 or 20
PA Pivot axis of the transfer elements 14
MA Machine or rotor axis

The invention claimed is:

1. An apparatus for use in connection with application of decoration to a container by printing thereon, said apparatus comprising a container transport system comprising a first processing position, a first coating installation, and a first transfer element comprising a permeable transfer coat, said transfer coat being permeable to a flowable coating material, wherein said first processing position is configured to receive a first container, wherein said first coating installation is disposed at said first processing position, wherein said first coating installation comprises said first transfer element, wherein said first transfer element is configured to apply a base coat to said first container, and wherein said first transfer element applies said base coat by at least one of rolling on said container and rolling off said first container, said apparatus further comprising a porous wall, wherein said first transfer element comprises said porous wall in said transfer coat, wherein said porous wall comprises a carrier-and-distribution coat, wherein said porous wall comprises a plurality of openings, wherein said openings are selected from the group consisting of micro-openings and micro-pores, wherein said openings enable said base coat material to be transported under pressure and evenly distributed onto said transfer coat, wherein said base coat material is transported in an axial direction that is radial to at least one of a circulation of said first transfer element, an axis of rotation of said first transfer element, and an axis of rotation of a carrier of said first transfer element.

2. The apparatus of claim 1, wherein said first transfer element is a rotating transfer element, wherein said rotating transfer element comprises a transfer coat, and wherein said first container rolls in a slip-free manner on an outer surface of said first transfer element to receive said base coat.

3. The apparatus of claim 1, wherein said first transfer element is configured such that, in operation, said first transfer element avoids contact with said first container.

4. The apparatus of claim 3, wherein, in an area of greatest proximity between said first container and said first transfer element, said first container and said first transfer element are separated by a perpendicular surface distance, and wherein said perpendicular surface distance is adjustable.

5. The apparatus of claim 1, wherein said transfer coat comprises a sponge-like buffer coat.

6. The apparatus of claim 1, wherein said first transfer element comprises a rotating transfer element, wherein said first coating installation comprises a station, wherein said rotating transfer element is moved past said station to apply base coat material onto said transfer coat before said rotating transfer element, in its further circulation, reaches a transfer position at which said first container is rolled on said transfer coat.

7. The apparatus of claim 6, further comprising a sensor disposed at said transfer position, wherein said sensor is configured to measure a distance between said first container and a structure selected from the group consisting of said first transfer element and said transfer coat.

8. The apparatus of claim 1, further comprising a supply-or-buffer chamber, wherein said porous wall separates an inside of said supply-or-buffer chamber from at least one of said transfer coat and a damping-and-buffer coat, wherein said inside of said supply-or-buffer chamber is connected by a pipe to a source that supplies said base coat material under pressure to said supply-or-buffer chamber, wherein said supply-or-buffer chamber is connected to a further pipe, and wherein said further pipe is disposed to return base coat material from said supply-or-buffer chamber to said source.

9. The apparatus of claim 1, further comprising a carrier that can be driven for rotation around a carrier axis, wherein said first transfer element is disposed on said carrier, said apparatus further comprising a second transfer element that has the same structure as said first transfer element, wherein said second transfer element is disposed on said carrier.

10. The apparatus of claim 1, further comprising a draining installation to collect excess base coat material from a location, wherein said location is selected from the group consisting of a transfer area between said first container and said first transfer element, a damping-and-buffer coat that forms a transfer coat, and a porous wall that acts as a carrier-and-distribution coat.

11. The apparatus of claim 1, further comprising a heating installation for tempering said base coat material, wherein said heating installation is arranged in the supply-or-buffer chamber.

12. The apparatus of claim 1, further comprising a sensor disposed at said transfer position, wherein said sensor is configured to monitor application of said base coat on said first container.

13. The apparatus of claim 1, further comprising a first rotor that can be driven to rotate about a vertical machine axis, wherein said first processing position is disposed on said first rotor, said apparatus further comprising a second processing position disposed on said first rotor, said second processing position being configured to receive a second container, wherein said second processing position comprises a second coating installation wherein said second coating installation comprises a second transfer element, wherein said second transfer element is configured to apply a base coat to said second container, and wherein said second transfer element applies said base coat by at least one of rolling on said container and rolling off said second container.

14. The apparatus of claim 13, further comprising a second rotor disposed to receive containers from said first rotor, wherein said second rotor comprises processing positions for printing onto said base coat provided at said first rotor, wherein said first and second rotors define at least part of a transport stretch.

15. The apparatus of claim 1, further comprising a closing element provided on said first transfer element, wherein said closing element is selected from the group consisting of a one-part closing element and a multi-part closing element, wherein said closing element is at least one of a pivoting closure element and a movable closure element, and wherein said closing element is selected from the group consisting of a closure cap and a cover.

16. The apparatus of claim 15, wherein said first transfer element comprises a transfer coat, wherein said closure element, when brought to a position at which said closure element is to be used, cooperates with said transfer coat to form one of an outlet space and a gap, wherein a fluid selected from the group consisting of a cleaning agent and a solvent flows in a circuit that passes through said one of an outlet space and a gap.

17. The apparatus of claim 1, further comprising an inkjet print head disposed to direct ink toward said base coat on said first container.

18. The apparatus of claim 1, wherein said base coat comprises a print-carrier coat.

* * * * *